US006974912B2

(12) United States Patent
Selby

(10) Patent No.: US 6,974,912 B2
(45) Date of Patent: Dec. 13, 2005

(54) INSULATOR AND CONNECT CABLE AND METHOD OF MAKING SAME

(76) Inventor: Peter E. Selby, 5006 St. Rte. 122 B, Eaton, OH (US) 45320

( * ) Notice: Subject to any disclaimer, the term of this patent is extended or adjusted under 35 U.S.C. 154(b) by 0 days.

(21) Appl. No.: 10/794,101

(22) Filed: Mar. 5, 2004

(65) Prior Publication Data

US 2005/0194177 A1 Sep. 8, 2005

(51) Int. Cl.[7] ..... H01B 7/00
(52) U.S. Cl. ..... 174/110 R; 174/111
(58) Field of Search ..... 174/36, 110 R, 174/111, 113 R, 113 AS, 113 C, 115, 116

(56) References Cited

U.S. PATENT DOCUMENTS 1,667,510 A * 4/1928 Coe ..... 174/131 A
1,912,794 A * 6/1933 Peterson ..... 174/28
2,105,060 A * 1/1938 Strom et al. ..... 174/111
2,243,881 A * 6/1941 Peters et al. ..... 156/51
2,510,358 A * 6/1950 Wolf ..... 156/47
2,556,224 A * 6/1951 Robertson ..... 174/29
2,566,335 A * 9/1951 Joerren ..... 338/26
2,587,916 A * 3/1952 Squier ..... 338/26
3,105,287 A * 10/1963 Whearley et al. ..... 29/605
3,309,455 A 3/1967 Mildner
3,928,519 A * 12/1975 Kashiyama et al. ..... 264/40.7
4,396,797 A * 8/1983 Sakuragi et al. ..... 174/68.3
5,143,123 A * 9/1992 Richards et al. ..... 138/120
5,192,834 A * 3/1993 Yamanishi et al. ... 174/120 SR
5,563,376 A * 10/1996 Hansell et al. ..... 174/102 R
5,929,374 A * 7/1999 Garland ..... 174/28

* cited by examiner

*Primary Examiner*—William H. Mayo, III
(74) *Attorney, Agent, or Firm*—R. William Graham

(57) ABSTRACT

An insulator and cable, wherein the insulator includes a spacer of low dielectric factor having a first end and a second end, wherein the first end comprises more than about three quarters of an axial length of the insulator and wherein the first end has a generally cylindrical opening extending axially therein of a diameter sufficiently larger than the wire diameter such that the wire can be axially extended through the opening without contacting the first end and the second end has a generally conical opening having a larger end communicating with the cylindrical opening and a smaller end adjacent a wire retaining surface.

19 Claims, 2 Drawing Sheets

INSULATOR AND CONNECT CABLE AND METHOD OF MAKING SAME

BACKGROUND OF THE INVENTION

1. Field of the Invention

The present invention, in general, relates to audio equipment and to audio cables used to supply a signal to stereophonic components such as amplifiers and preamplifiers and other audio/video components. More particularly, the present invention relates to an insulator and electric connect cable and method of making the same, wherein the cable has a low-dielectric characteristic for use in a wide variety of applications.

2. Description of the Prior Art

In an acoustic type of system, such as a stereo or a surround-sound system or a home-theater system or even an amplified live source of music, one or more speakers are required to produce sound. The quality of the sound that is ultimately produced is a function of each component of the acoustical system. Superior speakers will not produce superior sound without a superior amplifier. The quality of an audio system is a function of the lowest quality component connected to the system which in turn affects the quality of sound that can be produced.

Every component of an acoustical system mandates equality in order to achieve a maximum output for each component. Audio cables that supply the electrical signal and power from an amplifier to the speakers are critical components.

For example, if the electrical conductors that are used to form the audio cables are too small for the speakers and amplifier that are used, then power will be lost in the audio cables (by way of increased electrical resistance and a resulting voltage drop) and the sound that will be reproduced by the speakers, in particular the lower frequency sounds, will be adversely affected. Thus, a variety of sizes for the electrical conductors in the audio cables are provided in helping audiophiles match the size of the conductors in the audio cables with the power requirements of the audio system.

Another limitation that affects the sound quality of the audio system is the quality of the signal that is supplied to the speaker. A speaker is essentially a "dumb" transducer, having no way to differentiate distortion apart from the signal, i.e., music. It simply moves in response to the characteristics of the electrical waveform that drives it. It is a linear motor that moves back and forth as a result of magnetic attraction and repulsion. In general, the design and functioning of speakers is well understood in the audio arts. Therefore, it is important that the electrical waveform that drives each speaker be as perfect or as pure as possible. Deviation away from the ideal is, in general, referred to as "distortion" or "noise". If distortion is present in the waveform, the speaker will simply respond to the distortion that is present in the electrical waveform that is being supplied to it and it will reproduce it.

Therefore, the electrical components selected for every component, from tuner and preamplifier to power amplifier and including the audio cables that are used are designed to minimize distortion. When an electrical current is being propagated through a conductor, various distortions are produced in response to the flow of current through the conductor. These responses include the generation of an electromagnetic field around the audio cables themselves. This effect has been addressed by some audio engineers.

As the quality of audio systems has improved, the sound quality has improved. However, the improvement in sound technology has also made more noticeable sources of distortion.

The electromagnetic fields that are produced by the audio cables themselves combine with the electromagnetic fields that are produced by the audio cables at various locations along the length of the cable. This is because audio cables are not placed in a perfectly straight line and include curves and sometimes even loops to use up extra cable length.

The electromagnetic fields constructively and destructively interfere with each other and with the original waveform (i.e., the output from the power amplifier). The result is to alter the original electrical waveform before it reaches the speakers and to produce an impure, distorted sound. The distortion in the audio cables comes, in part, from the components that supply the original waveform and so the original waveform is inherently impure to at least some degree. Additional distortion arises from the electromagnetic emissions (i.e. radiation) from these (and other) components that are, in turn, received by the audio cables. This is because the audio cables function as antennas. While conventional shielding techniques provide some relief they are not effective at limiting distortions that are produced within the audio cable.

The alteration of the original waveform that is supplied to the speakers is another form of distortion that affects the sound quality that is ultimately reproduced by the speakers. This is because the constructive interference produces an electrical waveform to the speaker that is greater than that of the original electrical signal. Any destructive interference produces a waveform that is diminished from that of the original.

The electromagnetic emissions by the audio cables can further interfere with and degrade the performance of other audio components, such as that of the preamplifier, tuner, power amplifier, speakers, etc. In addition to the electromagnetic interference so produced, there are other anomalous forms of energy that are hypothesized to be produced within the audio cables that emanate therefrom. Sound, heat and mechanical distortions are also thought to affect the sound quality. It is desirable to minimize these distortions.

Attempts have been made to reduce the distortions that occur in audio cables. The use of copper as a conductor and stranded wire are examples of such attempts. Concentric conductor cables have long been used for transmission of sound and include dielectric washers between the concentric conductors made of rubber or. Helical polymer spacers have been used between olefin polymers to separate conductive layers. Subsequent developments in insulation material have significantly improved the quality of audio.

Ordinary air has a highly desirable dielectric factor of 1.0. Teflon, with a dielectric factor of 2.1–2.3, became the industry standard in the 1980's. Developments regarding wire placement wrapping and coiling along with improvements in raw materials, such as oxygen-free copper (OFC) and high-purity silver (FPS) resulted in even better audio cable quality. As the sophistication of audio cable increased, the steps taken to address electromagnetic parameters associated with musical reproduction became more and more complex, such as the incorporation of resistors and capacitors into the cable itself.

All prior art high-fidelity cables are generally comprised of conductors insulated with a continuous segment of a hard material such as Teflon, polystyrene, or polypropylene. The dielectric properties of these hard materials significantly restrict the natural flow of electrons and lack the dampening capabilities of the resonances associated with the natural vibrations of the signal conductors. As a result, the nuances of these vibrations smear, exaggerate and/or mask the delicate inner detail of the signal thus depriving the listener of the full sonic integrity and naturalness of the auditory experience being reproduced.

Electron seepage through the insulator on cables in the prior art is a function of its dielectric factor. One attempt to address the problem uses balsa wood as an insulation which has a very low dielectric factor of (1.4) which in itself causes very little electron seepage. The balsa insulation materials are arranged in a series of vertebrae to permit the same to be bent.

While the attempts to improve cable have increased sound performance, they have done so in a relatively costly manner. Accordingly, there remains a need for an improved cable for reducing noise and distortion and method of making the same.

SUMMARY OF THE INVENTION

It is an object of the present invention to provide a cable with reduced distortion characteristics.

It is another object to improve the method of making cable having reduced distortion characteristics.

It is also an object to reduce noise and distortion in an audio system.

Still another object is to provide an audio cable that produces a cleaner sound.

Yet another important object is to provide a cable for reducing noise and distortion and method of making the same that is inexpensive.

An object of the invention is to provide a cable for reducing noise and distortion and method of making the same that can be readily bent along a radius.

A further object is to provide an improved insulator used in forming cable.

Accordingly, the invention is directed to an insulator and cable for reducing noise and distortion and method of making the same. The insulator for use in forming the cable having a wire therethrough includes a spacer having a body of relatively low dielectric factor having a first end and a second end. The first end has an opening extending axially therein of a diameter sufficiently larger than the wire diameter such that the wire can be axially extended through the opening without contacting the first end. The second end has an opening adjacent a wire retaining surface wherein the openings are in communication with one another. The wire retaining surface is of a diameter to frictionally retain the wire. A plurality of insulators as described are disposed adjacent one another with a respective first end of one spacer adjacent a respective second end of another spacer.

Accordingly, the wire is axially suspended in each opening of each first end and retained by each second end. Preferably, the first end comprises a majority of the length of the insulator and thus the wire contacts a minimal part of the insulator with the majority of the wire suspended in air having a dielectric factor of 1. The wire retaining surface can preferably be tapered.

A cable for reducing noise and distortion is provided by having the described insulators therein which house in a suspended manner the wire. The cable preferably has a cover formed about the insulators and wire, wherein the method of forming the cable includes heat shrinking the cover. The cable includes ends which can be fitted with a component connector.

Further objects and advantages will be understood from reading the description and drawings which follow.

DETAILED DESCRIPTION OF THE INVENTION

Figure 1:
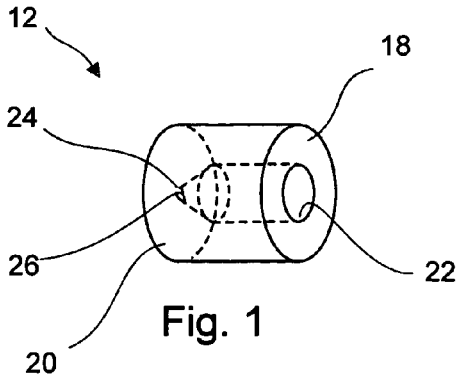
FIG. 1 is a view in perspective of an insulator of the invention.
Figure 2:
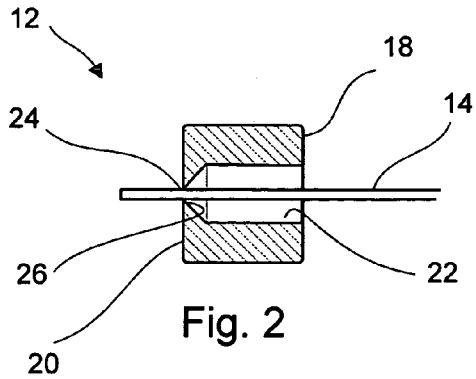
FIG. 2 is a cross sectional view taken on the line 2—2 in FIG. 1.
Figure 3:
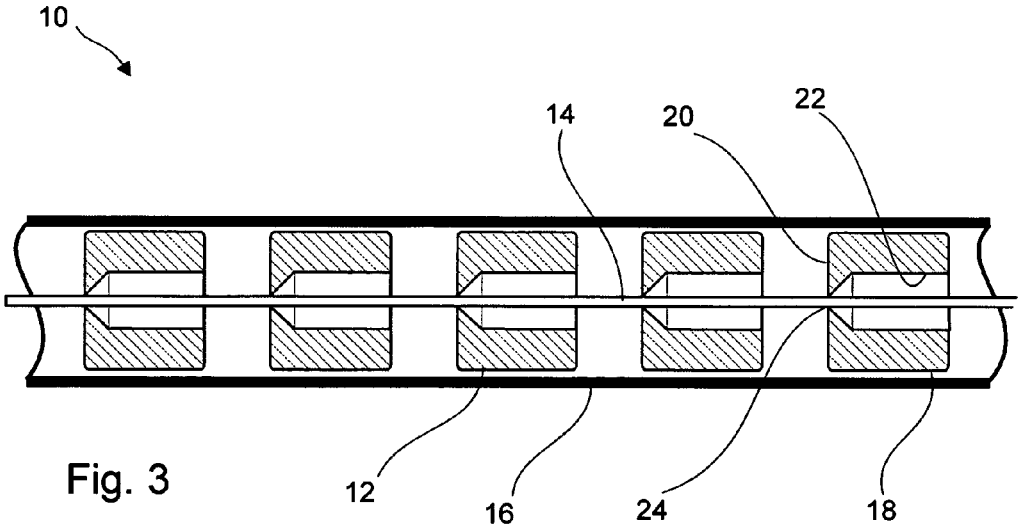
FIG. 3 is a cross sectional view of a part of a cable in accordance with the invention.
Figure 5:
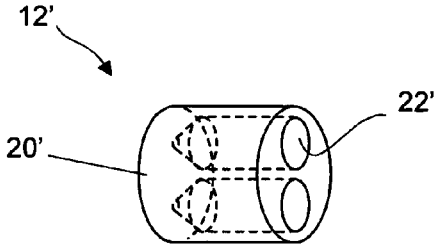
FIG. 5 is a perspective view illustrating another embodiment of the insulator of the invention.

Referring to the drawings, the cable for reducing noise and distortion is generally identified by the reference numeral 10. Referring now primarily to FIGS. 1–4B, an insulator 12 (or a plurality of insulators 12) is provided for use in forming the cable 10. The insulator 12 can be made of a material which preferably has a relatively low dielectric factor such as Teflon, but it is conceivably that other materials can be employed such as vinyl, nylon, polyethylene, polypropylene, or wood. Teflon has been found highly suitable for the instant invention as it is relatively hard and durable and has a low dielectric.

The insulator 12 has a wire 14 therethrough serves as a spacer for the wire 14 from an outside cover 16. The insulator 12 preferably has a body of relatively low dielectric factor yet a durable structure to prevent wearing due to the movement of the wire 14 in bending and use of the cable 10.

The insulator 12 has a first end 18 and a second end 20, wherein the end 18 comprises more than about three quarters of the axial length of the insulator 12. The first end 18 has a generally cylindrical opening 22 extending axially therein of a diameter sufficiently larger than the wire diameter such that the wire 14 can be axially extended through the opening 22 without contacting the first end 18. The second end 20 has a generally conical opening 24 having a larger end communicating with opening 22 and a smaller end adjacent a wire retaining surface 26 wherein the openings 22 and 24 are in communication with one another.

The wire retaining surface 26 is of a diameter to frictionally retain the wire 14. A plurality of insulators 12 as described are disposed adjacent one another with their respective first end 18 adjacent their respective second end 20.

The wire 14 is axially suspended in each opening 22 of each first end 18 to prevent contact therewith and retained by each second end 20. Preferably, the first end 18 comprises a majority of the length of each insulator 12 and thus the wire 14 contacts a minimal part of the insulator 12 with the majority of the wire 14 suspended in air having a dielectric factor of 1. This provides for a significantly enhanced cable 10 to be formed with reduced noise and distortion characteristics. The wire retaining surface 26 can preferably be tapered to add structural support thereto.

The cable 10 for reducing noise and distortion is provided by having the described insulators 12 therein which house in a suspended manner the wire 14. The cable 10 preferably has cover 16 formed about the insulators 12 and wire 14. The insulators 12 are relatively short in length, for example, less than about an inch, and are spaced from one another relative the diameter size of opening 22 in order to accommodate bending the wire 14 at a predetermined arc without the wire 14 touching the end 18. The cover 16 can be composed of a flexible plastic, such as PVC type material.

The type of material used and the number of exterior casings employed depends on the application. The instant invention employs PVC heat shrinkable material. At each end of the cable are the cable links which serve as a bridge to mechanically interconnect components as known in the art. Since the variety of connectors in the art is extensive, specifying a particular arrangement for the link is not practical. The purpose of the link is to maintain the performance benefits unique to this invention while providing a means to make a practical connection to connection components common to the art (such as plugs, jacks and spades).

To that end, the interior portion of the link is composed of insulators 12 arranged in such a way that the wire 14 passing through the link are sufficiently isolated from each other as is required for the application involved. In accord with the spirit of the invention, air is the majority compound in contact with the wires. Thus, a superior low dielectric inherent of the cable proper is maintained.

Those skilled in the art will also appreciate that various options such as a single-ended interconnect with cast OFC RCA connectors, or a (balanced-line) interconnect with OFC XLR connectors are both available for extraordinary performance to match the full performance of the cable described in this invention. The invention provides for the extremely low resistance of the cable resulting in a significant increase in efficiency. For an audio application, performance with more efficiency than the present art has been observed. Such performance in an audio cable will allow the driving of amplification equipment at elevated power levels heretofore unobtainable at a less expensive cost by current art while displaying an unprecedented amount of control and detail over the entire audio spectrum.

The diversity of cable types which could utilize the novel attributes of the present invention include electro-optical micro fibers, telecommunications, computer, audio, robotics, aerospace, marine, and high voltage power cable. In addition, electromagnetic devices such as printed circuit boards, electrical connectors and switches could also benefit from the unique attributes of the present invention. The present invention provides a high fidelity electrical cable and connection system having reduced the following: inductive reactance; capacitance; inductance; mechanical resonances caused by electrical current that causes resonances thereby producing blurring; and a greatly reduced dielectric which reduces electron seepage, all in order to provide a more efficient, accurate and faster transmission of electronic signals. The invention also provides for faster, more efficient and accurate transmission of electronic signals using a high fidelity electrical cable and connection system having a greatly reduced overall dielectric, with reduced inductive reactance, reduced capacitance, reduced inductance, reduced mechanical resonances caused by electrical current (blurring), and reduced electron seepage.

Figure 4A:
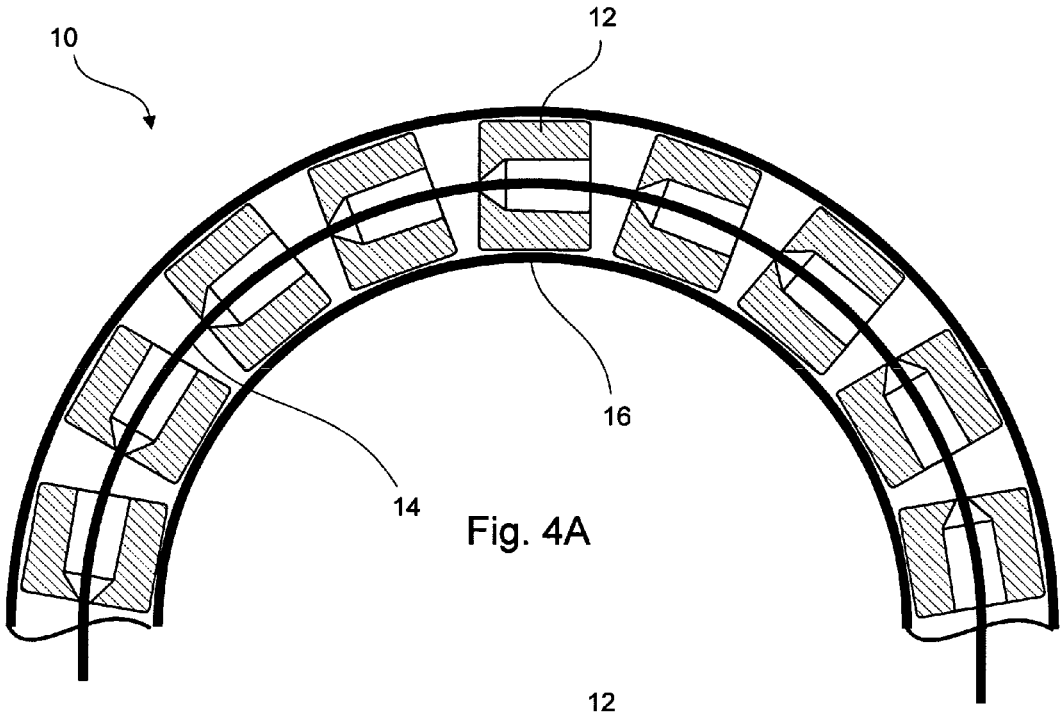
FIG. 4A is a partial cross sectional view of the cable illustrating a step in forming of the cable.
Figure 4B:
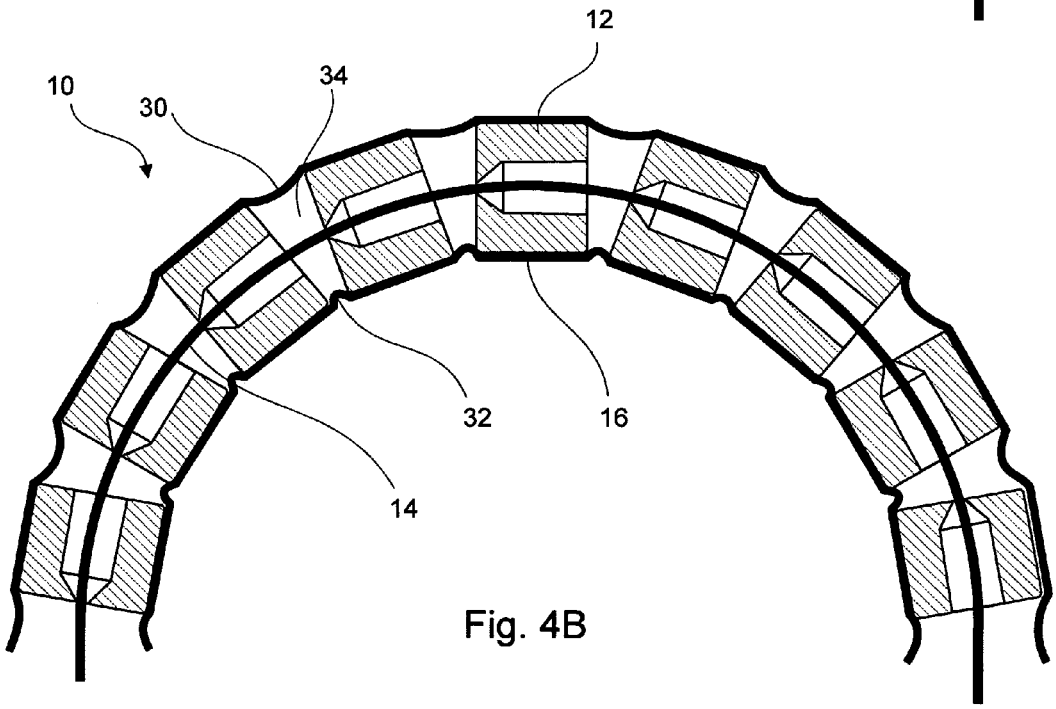
FIG. 4B is a partial cross sectional view of the cable illustrating another step in forming of the cable.

In forming the cable 10, the wire 14 is inserted through the insulators 12 preferably through end 18 to end 20. In this way, the insulators 12 are threaded on the wire 14 and are spaced as described above. Once a sufficient number of insulators 12 have been so threaded to achieve a suitable length, the cover 16 is slid over the insulators 12 and wire 14. The cover 16 and in turn wire 14 is bent as seen in FIG. 4A to a predetermined arc. The cover 16 is then subjected to sufficient heat to shrink the cover 16 onto the insulators 12. Portions 30 and 32 of the cover 16 slightly ingress into the trapezoidal space 34 formed between the insulators 12. By so doing, the cable 10 is formed with a predetermined curl which readily aids in the winding of the same, yet also permits the cable 10 to be straightened.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. An insulator for a cable for reducing noise and distortion therein wherein the cable includes a wire having a given diameter therein, which includes:

a spacer having a body of relatively low dielectric factor having a first end and a second end, said first end having a generally cylindrical opening extending axially therein of a diameter sufficiently larger than the wire diameter such that the wire can be axially extended through said opening without contacting said first end, said second end having a generally conical opening having a larger end communicating with said cylindrical opening and a smaller end adjacent a wire retaining surface, said wire retaining surface is of a diameter to frictionally retain the wire.

2. The insulator of claim 1, wherein said wire retaining surface is tapered.

3. The insulator of claim 1, wherein said first end comprises more than about three quarters of an axial length of said insulator.

4. A cable having reduced noise and distortion characteristics, which includes:

a wire a given diameter; and a first insulator spacer having a body of relatively low dielectric factor having a first end and a second end, said first end having a generally cylindrical opening extending axially therein of a diameter sufficiently larger than said wire diameter such that said wire can be axially extended through said opening without contacting said first end, said second end having a generally conical opening having a larger end communicating with said cylindrical opening and a smaller end adjacent a wire retaining surface, said wire retaining surface is of a diameter to frictionally retain said wire.

5. The cable of claim 4, wherein said wire retaining surface is tapered.

6. The insulator of claim 4, wherein said first end comprises more than about three quarters of an axial length of said insulator.

7. The cable of claim 4, which further includes a second insulator spacer having a body of relatively low dielectric factor having a first end and a second end, wherein said first end comprises more than about three quarters of an axial length of said insulator and said first end having a generally cylindrical opening extending axially therein of a diameter sufficiently larger than said wire diameter such that said wire can be axially extended through said opening without contacting said first end, said second end having a generally conical opening having a larger end communicating with said cylindrical opening and a smaller end adjacent a wire retaining surface, said wire retaining surface is of a diameter to frictionally retain said wire.

8. The cable of claim 7, wherein said first and second insulator spacers are disposed adjacent one another with a first end of said first insulator spacer adjacent a second end of said second insulator spacer.

9. The cable of claim 7, wherein said wire is axially suspended in each opening of each said first end and retained by each said second end.

10. The cable of claim 7, wherein each said wire retaining surface is tapered.

11. The cable of claim 7, which further includes a cover surrounding said first and second insulator spacers and said wire and wherein said insulators are in a spaced relation such that a trapezoidal space is formed therebetween such that said cable is formed with a predetermined curl.

12. The cable of claim 7, wherein said wire includes ends fitted with a component connector.

13. The cable of claim 4, which further includes a cover surrounding said first and second insulator spacers and said wire.

14. The cable of claim 4, wherein said wire includes ends fitted with a component connector.

15. A method of forming a cable, which includes the steps of:

inserting a wire of a given diameter through a first insulator spacer having a body of relatively low dielectric factor having a first end and a second end, wherein said first end comprises a substantial portion of an axial length of said insulator and wherein said first end having a generally conical opening extending axially therein of a diameter sufficiently larger than said wire diameter such that said wire can be axially extended through said opening without contacting said first end, said second end having a generally conical opening having a larger end communicating with said cylindrical opening and a smaller end adjacent a wire retaining surface, said wire retaining surface is of a diameter to frictionally retain said wire; and subsequently inserting said wire through a second insulator spacer having a body of relatively low dielectric factor having a first end and a second end, wherein said first end having an opening extending axially therein of a diameter sufficiently larger than said wire diameter such that said wire can be axially extended through said opening without contacting said first end, said second end having an opening adjacent a wire retaining surface wherein said openings are in communication with one another, said wire retaining surface is of a diameter to frictionally retain said wire.

16. The method of claim 15, which is further characterized such that said first and second insulator spacers are disposed adjacent one another with a first end of said first insulator spacer adjacent a second end of said second insulator spacer.

17. The method of claim 15, which further includes the steps of inserting said wire and spacers within a heat shrinkable cover, and heat shrinking said cover to contact and retain said spacers and wire therein.

18. The method of claim 17, which further includes the step of bending said wire and said cover to a predetermined angle prior to heat shrinking said cover such that said insulators are in a spaced relation such that a trapezoidal space is formed therebetween such that said cable is formed with a predetermined curl.

19. The method of claim 17, which further includes the step fitting an end of said wire with a component connector.

* * * * *